US010806991B2

(12) United States Patent
Monteith

(10) Patent No.: US 10,806,991 B2
(45) Date of Patent: Oct. 20, 2020

(54) CHALK-HOLDER FOR BILLIARD-CUES SYSTEM

(71) Applicant: Craig David Richard Monteith, Shelburne (CA)

(72) Inventor: Craig David Richard Monteith, Shelburne (CA)

( * ) Notice: Subject to any disclaimer, the term of this patent is extended or adjusted under 35 U.S.C. 154(b) by 0 days.

(21) Appl. No.: 16/251,068

(22) Filed: Jan. 17, 2019

(65) Prior Publication Data

US 2020/0230489 A1 Jul. 23, 2020

(51) Int. Cl.
*A63D 15/16* (2006.01)
*A63D 15/08* (2006.01)

(52) U.S. Cl.
CPC ..... *A63D 15/16* (2013.01); *A63D 15/08* (2013.01); *A63B 2243/002* (2013.01)

(58) Field of Classification Search
CPC .. A63D 15/16; A63D 15/08; A63B 2243/002; A45B 3/00
USPC ..... 473/46, 36, 1
See application file for complete search history.

(56) References Cited

U.S. PATENT DOCUMENTS 122,218 A * 12/1871 Bogert ..... A45B 3/00 473/46
437,746 A * 10/1890 Barber ..... A63D 15/16 473/36
507,471 A * 10/1893 Barger ..... A63D 15/16 473/36
516,472 A * 3/1894 Campbell ..... A63D 15/16 473/36
773,189 A * 10/1904 Bourget ..... A63D 15/16 473/36
939,156 A * 11/1909 Norman ..... A63D 15/16 473/36
4,314,575 A * 2/1982 Kuo ..... A45B 3/00 473/46
5,356,345 A * 10/1994 Peuplie ..... A63D 15/16 473/36
6,726,573 B2 * 4/2004 Edge ..... A63D 15/12 473/35
D724,685 S * 3/2015 Carroll ..... D21/789

* cited by examiner

*Primary Examiner* — Mitra Aryanpour
(74) *Attorney, Agent, or Firm* — Inspired Idea Solutions Law Firm; Wayne Carroll

(57) ABSTRACT

A chalk-holder for billiard-cues system including a chalk holder having a receptacle including an inner volume and a securing member. The inner volume is configured to store chalk for removeable use. The securing member is configured to engage and be secured at a handle-end of a pool cue for providing ready access to the chalk. The securing member comprises threading. The handle-end comprises an aperture configured to mate with the threading of the securing member. The device may be used to store chalk between uses during billiards.

5 Claims, 5 Drawing Sheets

CHALK-HOLDER FOR BILLIARD-CUES SYSTEM

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of receptacles and more specifically relates to a chalk holder.

2. Description of Related Art

Billiards games are mostly played with a stick known as a cue. A cue is usually either a one piece tapered stick or a two piece stick divided in the middle by a joint of metal or phenolic resin. High quality cues are generally two pieces and are made of a hardwood, generally maple for billiards and ash for snooker. The butt end of the cue is of larger circumference and is intended to be gripped by a player's hand. The shaft of the cue is of smaller circumference, usually tapering to an 0.4 to 0.55 inches terminus called a ferrule, where a rounded leather tip is affixed, flush with the ferrule, to make final contact with balls. The tip, in conjunction with chalk, can be used to impart spin to the cue ball when it is not hit in its center. It is customary for players after nearly every shot to go to a receptacle provided and take therefrom the chalk which it contains for the purpose of chalking the one tip and keeping it in proper condition to engage the ball without liability of slipping. Time is lost, and the attention is diverted from the game of the opposing player. A suitable solution is desired.

U.S. Pat. No. 9,391,56 to Carl Victor Norman relates to a chalk-holder. The described chalk-holder includes a simple, durable, and comparatively inexpensive chalk-holding attachment for cues, which is not only practicable, efficient, convenient, and compact, but prevents soiling the fingers with the chalk, something which heretofore it has not been easy to avoid; second, to provide such a device which can very readily be attached to the butt of any ordinary cue, and, third, to furnish a cue equipped with this holder with a cushion at the butt end, if desired.

BRIEF SUMMARY OF THE INVENTION

In view of the foregoing disadvantages inherent in the known billiards accessories art, the present disclosure provides a novel chalk-holder for billiard-cues system. The general purpose of the present disclosure, which will be described subsequently in greater detail, is to provide a convenient chalk storage solution.

A chalk-holder for billiard-cues system is disclosed herein. The chalk-holder for billiard-cues system includes a chalk holder having a receptacle including an inner volume and a securing member. The receptacle is configured at a first-end of the chalk holder and the securing member is configured at a second-end of the chalk holder. The inner volume is configured to store chalk for removeable use. The securing member is configured to engage and be secured at a handle-end of a pool cue for providing ready access to the chalk. The securing member comprises threading. The handle-end comprises an aperture configured to mate with the threading of the securing member. The aperture comprises a substantially similar aperture-diameter to a securing-member-diameter. The aperture comprises a depth suitable to receive the chalk holder and provide a flush connection. The receptacle includes a cylindrical profile.

According to another embodiment, a method of using the chalk-holder for billiard-cues system is also disclosed herein. The method of using the chalk-holder for billiard-cues system includes a providing a chalk holder, adding chalk to a receptacle of the chalk holder, securing a securing member of the chalk holder to a handle-end of a pool cue, and removing the chalk holder.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a chalk-holder for billiard-cues system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to billiards accessories and more particularly to a chalk-holder for billiard-cues system as used to improve the storage and use of chalk during a game of billiards.

Generally, the present invention is a chalk holder for a pool cue stick having a threaded bottom that easily attaches and releases from the bottom handle portion of a cue. The device provides a convenient storage location and apparatus for chalk during billiards.

Figure 1:
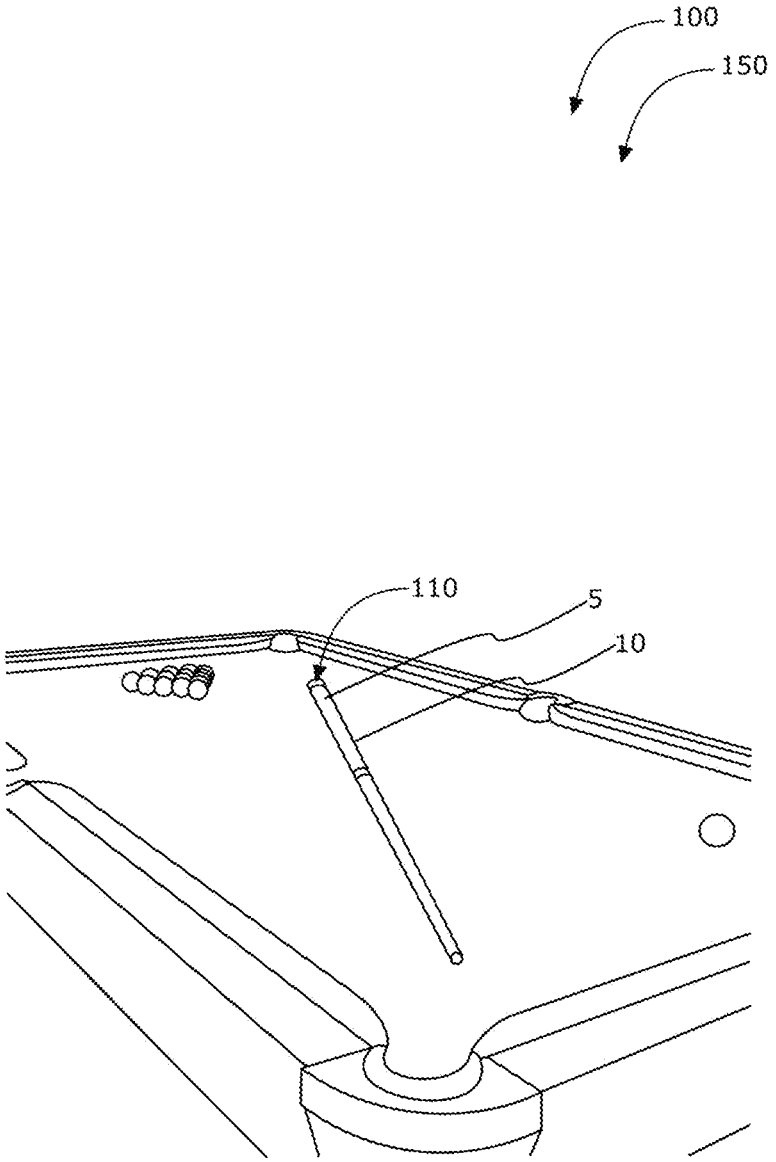
FIG. 1 is a front perspective view of the chalk-holder for billiard-cues system during an 'in-use' condition, according to an embodiment of the disclosure.

Referring now more specifically to the drawings by numerals of reference, there is shown in FIGS. 1-5, various views of a chalk-holder for billiard-cues system 100. FIG. 1 shows a chalk-holder for billiard-cues system 100 during an 'in-use' condition 150, according to an embodiment of the present disclosure. As illustrated, the chalk-holder for billiard-cues system 100 may include a chalk holder 110 having a receptacle 120 including an inner volume 122 and a securing member 130. The chalk holder 110 is configured to be secured to a handle-end 5 of a pool cue 10 for providing ready access to chalk 15.

Figure 2:
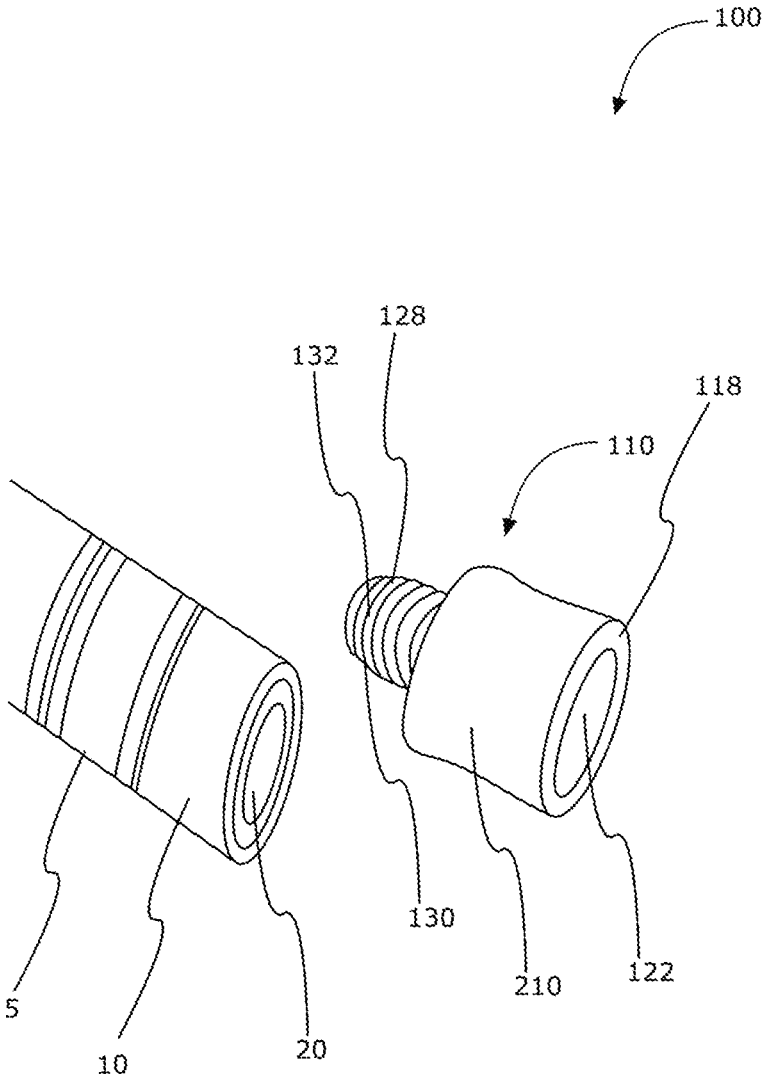
FIG. 2 is a front perspective view of the chalk-holder for billiard-cues system of FIG. 1, according to an embodiment of the present disclosure.

FIG. 2 shows a perspective view of the chalk-holder for billiard-cues system 100 of FIG. 1, according to an embodiment of the present disclosure. As above, the chalk-holder for billiard-cues system 100 may include the chalk holder 110 having the receptacle 120 including the inner volume 122 and the securing member 130. The receptacle 120 is configured at a first-end 118 of the chalk holder 110 and the securing member 130 is configured at a second-end 128 of the chalk holder 110. The inner volume 122 is configured to store chalk 15 for removeable use. The securing member 130 is configured to engage and be secured at a handle-end 5 of a pool cue 10 for providing ready access to the chalk 15. The chalk holder 110 is attachable to a standard pool cue 10 and the chalk 15 may be removeable and replaceable.

Figure 3:
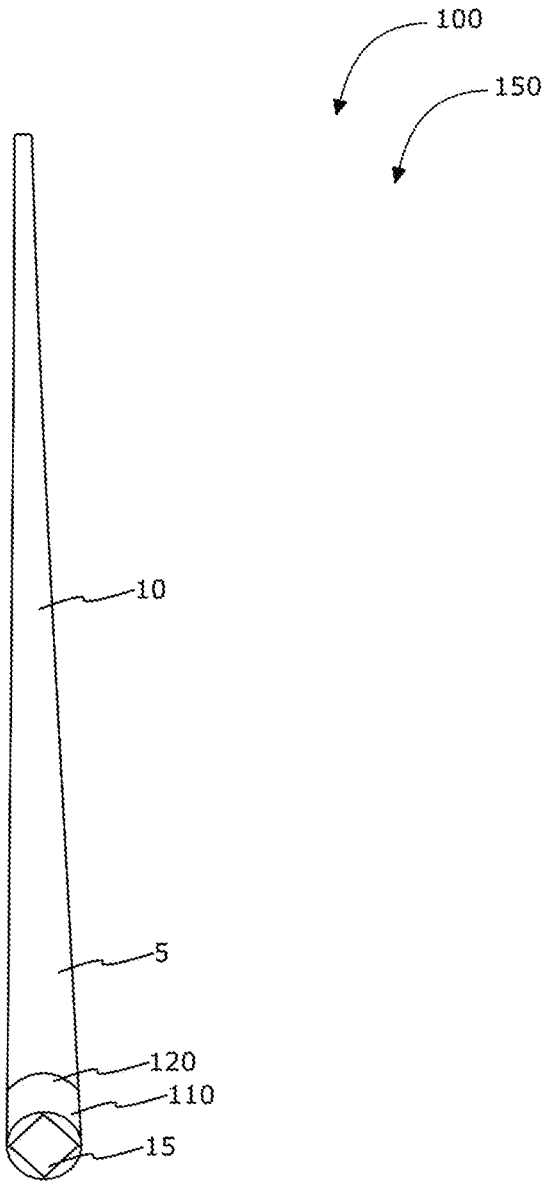
FIG. 3 is a front perspective view of the chalk-holder for billiard-cues system of FIG. 1, according to an embodiment of the present disclosure.

Referring now to FIG. 3 showing a perspective view of the chalk-holder for billiard-cues system 100 of FIG. 1, according to an embodiment of the present disclosure. As above, the chalk-holder for billiard-cues system 100 may include the chalk holder 110 having the receptacle 120 including the inner volume 122 and the securing member 130. In a preferred embodiment, the securing member 130 comprises threading 132 at an opposing end to the inner volume 122 and receptacle 120. The threading 132 protrudes from the receptacle 120 and provides a screw-like fastener for securing to the handle-end 5 of a pool cue 10. The handle-end 5 comprises an aperture 20 configured to mate with the threading 132 of the securing member 130. The aperture 20 comprises a substantially similar aperture-diameter to a securing-member-diameter. The aperture 20 comprises a depth suitable to receive the chalk holder 110 and provide a flush connection. The receptacle 120 includes a cylindrical profile.

Figure 4:
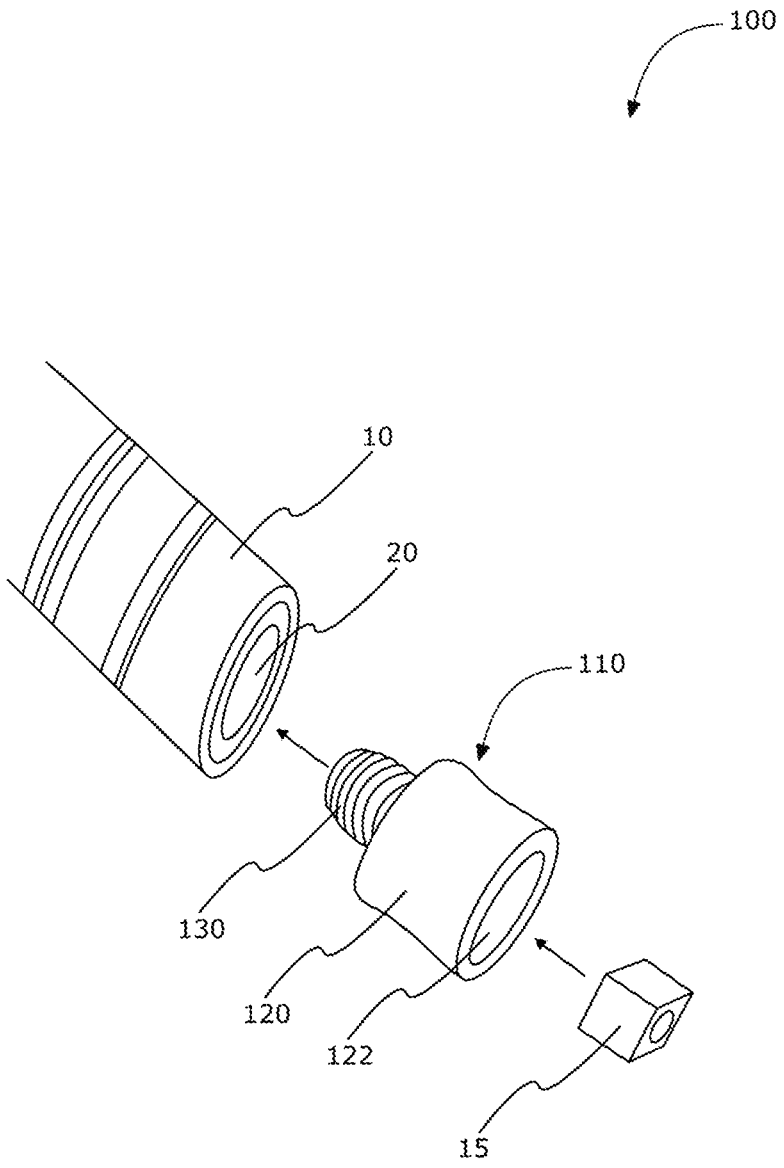
FIG. 4 is a front perspective view of the chalk-holder for billiard-cues system of FIG. 1, according to an embodiment of the present disclosure.

FIG. 4 shows a perspective view of the chalk-holder for billiard-cues system 100 of FIG. 1, according to an embodiment of the present disclosure. As above, the chalk-holder for billiard-cues system 100 may include the chalk holder 110 having the receptacle 120 and the securing member 130. The receptacle 120 is preferably semi-rigid. The inner volume 122 of the receptacle 120 is configured to receive a cube of chalk 15. The cube of chalk 15 is friction-fit within the inner volume during use. Outer edges of the cube of chalk touch walls of the inner volume 122 during use keeping the cube of chalk 15 friction-fit within the inner volume 122. The receptacle 120 comprises a receptacle-depth to receive the cube of chalk 15, the cube of chalk 15 being flush with an outer rim of the receptacle 120 during use. The receptacle 120 comprises an open-end exposing the inner volume 122. The inner volume 122 comprises a cylindrical-shape or other suitable shape for receiving a cube of chalk 15 or other chalk insert.

Figure 5:
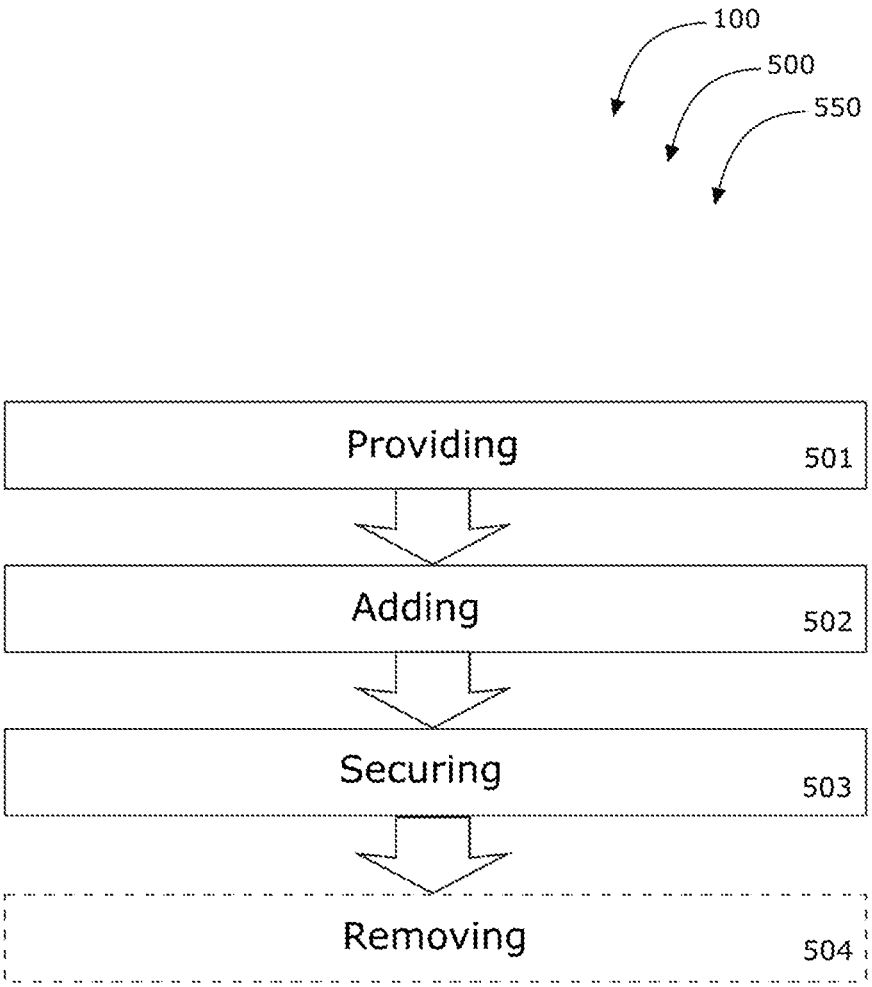
FIG. 5 is a flow diagram illustrating a method of use for the chalk-holder for billiard-cues system, according to an embodiment of the present disclosure.

Referring now to FIG. 5 a flow diagram illustrating a method for using 500 the chalk-holder for billiard-cues system, according to an embodiment of the present disclosure. In particular, the method of using 500 the chalk-holder for billiard-cues system 100 may include one or more components or features of the chalk-holder for billiard-cues system 100 as described above. As illustrated, the method for using 500 the chalk-holder for billiard-cues system 100 may include the steps of: step one 501, providing a chalk holder 110; step two 502, adding chalk 15 to a receptacle 120 of the chalk holder 110; step three 503, securing a securing member 130 of the chalk holder 110 to a handle-end 5 of a pool cue 10; step four 504, removing the chalk holder 110.

It should be noted that step four 504 is an optional step and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for using the chalk-holder for billiard-cues system, are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A chalk-holder for attachment to a butt-end of a cue stick comprising:

a semi-rigid receptacle having a cylindrical outer profile including an inner volume having an open end exposing said inner volume and a closed end;

a securing member including a threaded shaft, wherein said securing member is formed integral with the closed end of the semi-rigid receptacle;

a threaded bore formed at said butt-end of the cue stick, wherein said threaded shaft of said securing member threadably engages the threaded bore of the butt-end of the cue stick; and a chalk removably and replaceably received within the inner volume of said semi-rigid receptacle.

2. The chalk-holder for billiard-cues system of claim 1, wherein said chalk is a cube-shaped and configured to be received within said inner volume of said receptacle.

3. The chalk-holder for billiard-cues system of claim 2, wherein said cube of chalk is friction-fit within said inner volume.

4. The chalk-holder for billiard-cues system of claim 3, wherein outer edges of said cube of chalk touch walls of said inner volume keeping said cube of chalk friction-fit within said inner volume.

5. The chalk-holder for billiard-cues system of claim 2, wherein said receptacle comprises a receptacle-depth to receive said cube of chalk, said cube of chalk being flush with an outer rim of said receptacle.

* * * * *